US006802327B2

(12) United States Patent
Koss

(10) Patent No.: US 6,802,327 B2
(45) Date of Patent: Oct. 12, 2004

(54) RETRACTABLE PORTABLE SHELTER WITH AN ATTACHMENT FOR VEHICLES

(76) Inventor: Dennis R. Koss, W6708 Hwy. 33, Portage, WI (US) 53901

( * ) Notice: Subject to any disclaimer, the term of this patent is extended or adjusted under 35 U.S.C. 154(b) by 0 days.

(21) Appl. No.: 10/271,374

(22) Filed: Oct. 15, 2002

(65) Prior Publication Data

US 2004/0069338 A1 Apr. 15, 2004

(51) Int. Cl.[7] ..... E04H 15/06

(52) U.S. Cl. ..... 135/88.08; 135/88.15; 135/137; 135/901; 296/159; 296/173; 296/77.1

(58) Field of Search ..... 135/88.08, 88.01, 135/88.13, 88.15, 132, 133, 137, 116, 901; 296/158, 159, 161, 163, 173, 77.1; 114/344, 361

(56) References Cited

U.S. PATENT DOCUMENTS

| | | | | |
|---|---|---|---|---|
| 3,351,373 A | * | 11/1967 | Christin | 296/172 |
| 4,088,363 A | * | 5/1978 | Palmer | 296/161 |
| 4,239,247 A | * | 12/1980 | Hinz | 280/19.1 |
| 4,263,925 A | | 4/1981 | Arganbright | |
| 4,554,884 A | * | 11/1985 | Bouliane | 114/344 |
| 4,716,919 A | * | 1/1988 | Griffin | 135/133 |
| 4,870,984 A | * | 10/1989 | Roth | 135/148 |
| 4,907,728 A | * | 3/1990 | Giblet | 224/585 |
| 5,313,972 A | | 5/1994 | Goldberg | |
| 5,341,588 A | | 8/1994 | Lizotte | |
| 5,368,057 A | | 11/1994 | Lubkeman et al. | |
| 5,660,425 A | | 8/1997 | Weber | |
| 5,720,312 A | | 2/1998 | Scheuermann | |
| 6,017,081 A | | 1/2000 | Colby | |
| 6,155,279 A | | 12/2000 | Humphrey | |
| 6,179,368 B1 | * | 1/2001 | Karlsson | 296/161 |
| 6,397,870 B1 | | 6/2002 | Makedonsky et al. | |
| 6,402,220 B2 | | 6/2002 | Allen | |

FOREIGN PATENT DOCUMENTS

| | | | |
|---|---|---|---|
| FR | 2601305 | * | 1/1988 |

* cited by examiner

*Primary Examiner*—Winnie Yip
(74) *Attorney, Agent, or Firm*—LaFollette Godfrey & Kahn; Sonali S. Srivastava

(57) ABSTRACT

Disclosed is a retractable portable shelter apparatus with an attachment apparatus for vehicles. The shelter apparatus includes a stationary frame, a plurality of pivotably rotatable frames, a collapsible canopy stretched over the rotatable frames, and an attachment member for attaching the apparatus to the vehicle. The vehicle attachment apparatus can be moved between at least two positions, the deployed, substantially enclosed housing position, and the substantially closed or collapsed position. The shelter apparatus may be used as an ice fishing shelter, a duck hunting blind, a tent, a camping shelter, a portable shower facility, a storage tent, a sun shade, a hunting rack for carrying hunted animals, a medical emergency shelter, or a tool carrier. In one embodiment the shelter apparatus includes a platform for supporting a user, and further includes a floor and wheels supporting the floor.

29 Claims, 2 Drawing Sheets

RETRACTABLE PORTABLE SHELTER WITH AN ATTACHMENT FOR VEHICLES

BACKGROUND OF THE INVENTION

This invention generally relates to a retractable enclosed shelter. Specifically the invention relates to a retractable portable shelter with an attachment for vehicles, wherein the shelter may be an ice fishing shelter, a duck hunting blind, a tent, a camping shelter, a portable shower facility, a storage tent, a sun shade, a hunting rack for carrying hunted animals, a medical emergency shelter or a tool carrier.

Portable shelters are used for mitigating the elements of nature during the challenging conditions associated with various outdoor activities. An enclosed shelter is useful in providing some protection against these elements of nature, along with enhancing privacy of the shelter user.

Traditionally, these shelters are not known to be very portable, and attempts to solve this portability problem, while still providing sufficient shelter, have been many.

U.S. Pat. No. 6,017,081 to Colby relates to a convertible trailer which can be used as a utility trailer that converts to an ice fishing shelter, hunting blind, camping shelter, portable shower facility or storage tent. The trailer includes a winch and when the winch is engaged, the convertible trailer is unrighted and the canopy assembly is automatically deployed. When the winch is disengaged, the canopy automatically collapses. This trailer, however, is very cumbersome and requires a winch to make it into a shelter.

U.S. Pat. No. 5,368,057 to Lubkeman et al. discloses a collapsible ice fishing shelter comprising a thermoformed plastic base that has a floor with upstanding side walls. This shelter, however, requires assembly before it can be used as a shelter.

U.S. Pat. No. 6,397,870 B1 to Makedonsky et al. discloses a portable ice fishing shelter where the hull unit includes a hull member having a floor surrounded by raised exterior side walls, an enlarged aperture that is dimensioned to receive the lower torso of an adult and means for carrying the hull member. The shelter membrane halves are connected to the hull member such that the fabric covering can be engaged or disengaged. This shelter, however, requires manual lifting for transporting the shelter from one location to another.

U.S. Pat. No. 4,263,925 to Arganbright relates to a multipurpose tent which can be mounted on a conventional pick-up truck as well as staked on the ground or other supporting surface in a conventional manner. The multipurpose tent however requires significant assembly before it may be used as a shelter.

U.S. Pat. No. 5,341,588 to Lizotte relates to a portable ice fishing hut that is readily transportable in either a collapsed orientation or a deployed orientation, comprising, in combination, a housing base having a horizontal central platform. The fishing hut, however, is transported using a pair of parallel skids positioned beneath the central platform.

U.S. Pat. No. 5,720,312 to Scheuermann discloses a collapsible and portable fishing shelter or survival unit that can be transported anywhere a snowmobile can go. The collapsible shelter comprises, in combination, a plurality of support members for releasable securements of a snowmobile. One or more cover members are provided for releasable securement to the plurality of support members and/or the snowmobile to form a collapsible shelter releasably interconnected with the snowmobile. This shelter, however, requires the snowmobile to be used as a base, and may not be easily transferable to another vehicle without modifying the basic shelter structure.

U.S. Pat. No. 5,313,972 to Goldberg relates to an assembly for providing a shelter to both a personal riding vehicle, such as a motorcycle or a bicycle, and one or more people. The assembly incorporates the vehicles as part of the support structure. When not in use, the tent assembly can be rolled up and easily stored. This shelter however requires a personal riding vehicle and requires a significant amount of assembly before it may be used as a shelter.

U.S. Pat. No. 6,402,220 B2 to Allen relates to a portable enclosure for an ATV that includes a number of monitoring brackets that are assembled to the vehicle's cargo racks. The enclosure comprises a pair of support rods that are remountably connected to the mounting brackets. The enclosure additionally comprises front, rear and side panels with windows and may be segmented and folded into a carrying case. Allen's shelter, however, requires cumbersome assembly before it may be used as a shelter.

U.S. Pat. No. 5,660,425 to Weber discloses a collapsible frame assembly that provides shelter adjacent to a motor vehicle. The invention includes a collapsible frame assembly and leg means for supporting a portion of the main frame assembly at a desired elevation above the ground. One clamp assembly securely attaches the main frame assembly to at least a portion of the vehicle. The main frame assembly supports a main cover. The cover provides shelter adjacent to the motor vehicle. The shed, however, may not be used instantly, and requires cumbersome assembly.

U.S. Pat. No. 6,155,279 to Humphery relates to a portable sports shed that is adapted for residing in the bed of a pick-up truck that can be easily placed and removed. The interior floor of the shed is provided with grooves that are spaced apart to accommodate the skis of a snowmobile or wheels of an ATV or a riding lawnmower. Humphrey's shed also may not be used instantaneously and may require cumbersome assembly.

Each of these references teaches one or more shelters that are in a sense portable. These prior art shelters, however, are cumbersome; require substantial assembly, and are not necessarily easily transportable, quickly disengageable or easily stored away. Accordingly, the need exists for an improved portable shelter that is easily collapsible, easily transportable, easily stored away, economically produced and quickly disengageable from the attached transportation vehicle.

BRIEF SUMMARY OF THE INVENTION

The present invention may be used in a multitude of systems where the above mentioned capabilities are desired, for example, as a hunting blind, camping shelter, portable shower facility, storage tent, a hunting rack for carrying hunted animals, a medical emergency shelter, a tool carrier, etc. Thus, the invention provides a retractable portable shelter apparatus for a vehicle. The shelter apparatus includes a stationary frame and a plurality of pivotably rotatable frames pivotably connected to the stationary frame. A collapsible canopy is connected to the stationary frame and the pivotably rotatable frames, and an attachment member connects the vehicle and the stationary frame.

In one embodiment of the present invention, the stationary frame further comprises at least one substantially rectangular frame located along the vertical axis of the apparatus. The stationary frame may further include at least two rectangular frames and at least one support spacer between the rectangular stationary frames, to maintain the relative orientation of the stationary frames. The apparatus may further include at least one support frame that may be used as a structural support for the apparatus and as a support for a person sitting on the stationary platform. The support frame may have attached to it at least one wheel to aid in the transportation of the apparatus.

In another embodiment of the present invention, the plurality of pivotably rotatable frames comprises at least one rotatable frame, or alternatively, at least two rotatable frames, including at least one last rotatable frame. The last rotatable frame may further enclose a floor, which may be made from a resilient, insulating material. The floor may also have an orifice, for permitting an ice fishing line to pass through the floor and through an ice-fishing surface into the water below. Also, the at least one wheel for aiding transportation, as referred to above, may be attached to the floor rather than the support frame.

In one embodiment of the present invention, the canopy moves between at least two positions; in one position, the canopy is substantially opened and forms an enclosed housing, and in another position, the canopy is substantially closed to form a closed accordion. The invention may further include a locking and unlocking member, which may be used for positioning the canopy in open and closed positions, and a connecting member for controlling the relative orientation of the plurality of rotatable frames in the positions described.

DETAILED DESCRIPTION OF THE INVENTION

Figure 1:
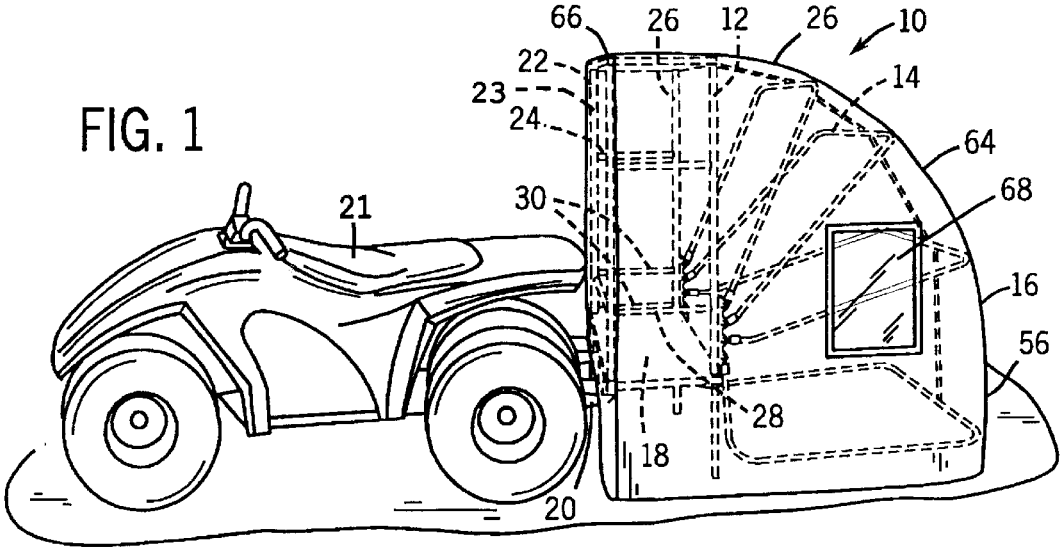
FIG. 1 is a side perspective view of a retractable portable shelter apparatus constructed according to one embodiment of the invention, wherein the apparatus is attached to an all terrain vehicle, with the collapsible canopy in a substantially fully deployed position.
Figure 2:
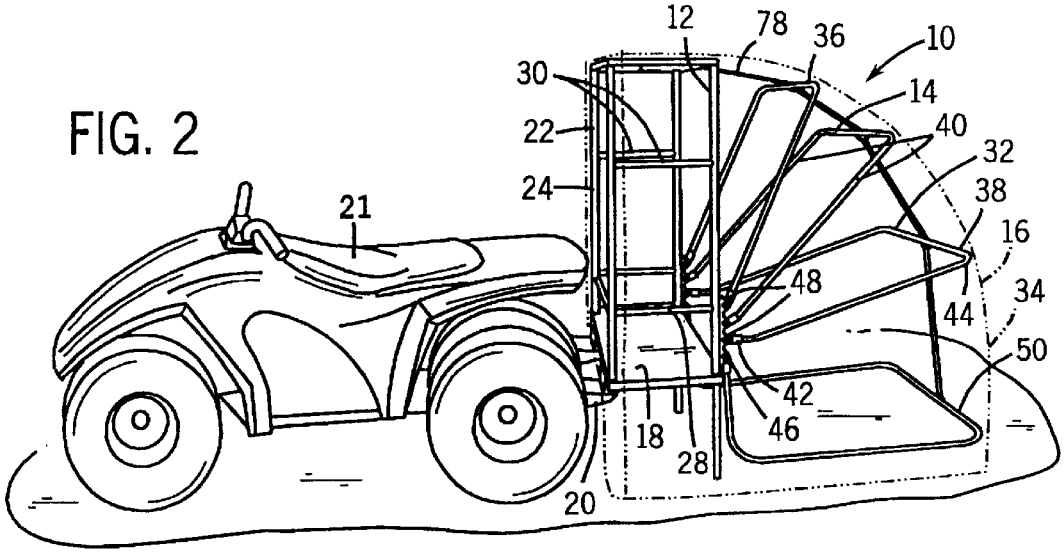
FIG. 2 is a side perspective view the shelter apparatus shown in FIG. 1, with the canopy shown in phantom to expose the structural members there beneath.

Referring now to FIGS. 1 and 2, one embodiment of a retractable portable shelter apparatus 10 according to the invention includes a stationary frame 12 having pivotably attached thereto a plurality of rotatable frames 14. A flexible canopy 16 is draped and extended over the frames 14. Also connected to the stationary frame 12 is an attachment member 20 for attaching the apparatus 10 to a vehicle 21, such as an all-terrain vehicle.

The stationary frame 12 is constructed of at least one frame member, hereafter first frame member 22, positioned substantially vertically with respect to the vehicle 21, and to which the rotatable frames 14 are pivotably attached. In one embodiment, the stationary frame 12 is further constructed of additional frame members, in effect forming a box, preferably a rectangular box 23. Specifically, first frame member 22 is joined to additional substantially vertical frame members 24, 26 and 28. These frame members 22, 24, 26 and 28 are substantially parallel to each other, and a plurality of support spacers 30 is used, positioned substantially horizontally between them, to improve structural stability of the stationary frame 12.

The plurality of pivotably rotatable frames 14 includes at least one and preferably more than one pivotably rotatable frame 14, to arch the canopy 16 in a desirable arcuate shape 34. Each rotatable frame 14 in a preferred embodiment comprises a U-shaped member 36. Each U-shaped member 36 is formed of a crossbar 38, connected at each end to one of two arms 40. Each arm 40 has a distal end 42 and a proximal end 44, the latter of which is connected to the arm 40. The distal end 42 of each arm 40, in turn is attached to the stationary frame 12 of the apparatus 10. The distal end 42 may be attached to the stationary frame 12 by any suitable conventional pivotable means. In one embodiment the top end 42 is attached to the stationary frame 12 using a mounting device 46. The mounting device 46 is attached to the stationary frame 12 and the several rotatable frames 14 are attached to the mounting device in a staggered position, whereby the several rotatable frames may be easily stacked together without occupying too much space. The rotatable frames 14 pivot around the attachment point and stack together in a closed or collapsed position.

Figure 3:
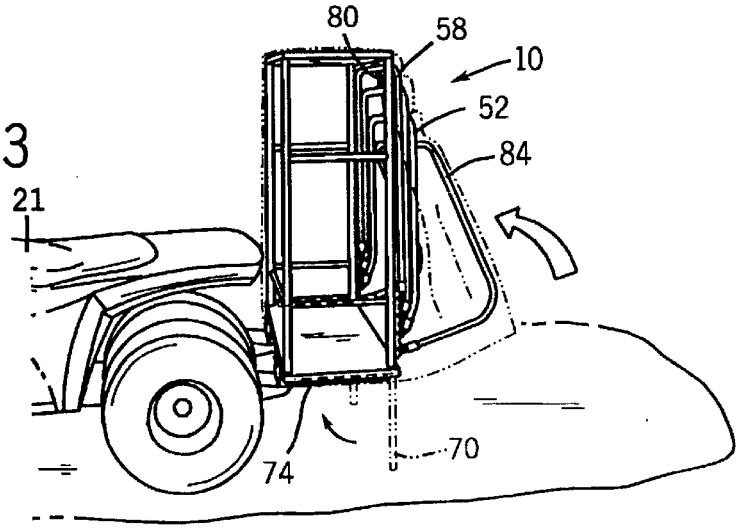
FIG. 3 is a side perspective view of the shelter apparatus shown in FIG. 2, shown in a collapsed position.
Figure 5:
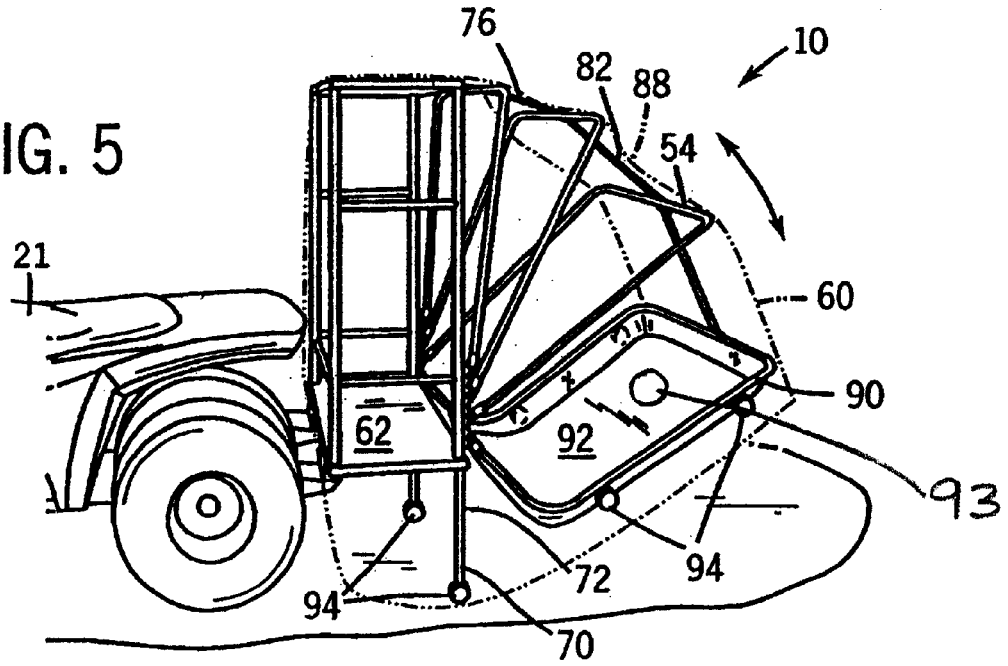
FIG. 5 is a side perspective view of a retractable portable shelter apparatus constructed according to another embodiment of the invention, wherein the shelter is in a partially deployed position, and the apparatus includes a floor and wheels.

The rotatable frames 14 are moveable between at least two positions, the substantially extended or deployed position 50, as seen in FIG. 2, and a substantially closed or collapsed position 52, as seen in FIG. 3. The rotatable frame, however, may exist in partially deployed or partially collapsed position 54, as seen in FIG. 5. This partial or intermediate position 54 may be used for entering or exiting the shelter apparatus 10 or, for example, as a sunshade, duck blind, or an emergency medical shelter for rescue operations.

Figure 4:
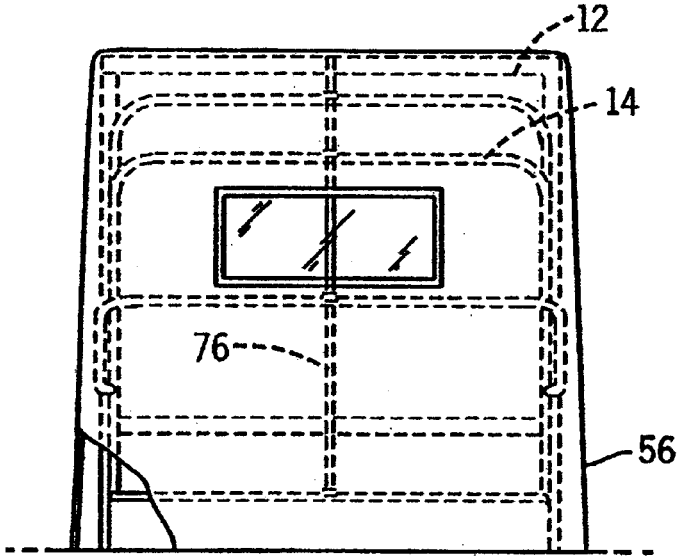
FIG. 4 is a rear plan view of a retractable portable shelter apparatus constructed according to another embodiment of the invention including a coverable window in the collapsible canopy, and with the canopy partially cut away to expose certain of the frame sections.

As seen in FIG. 1 the collapsible canopy 16 comprises at least in part one movable end 64 and one fixed end 66. The fixed end 66 substantially covers the stationary frame 12 of the apparatus 10. The moveable end 64 substantially covers the rotatable frame 14 of the apparatus 10. In one embodiment of the present invention, the shelter apparatus 10 further comprises a window 68. The window 68 may be coverable, and may be located in the movable end 64, at the side as shown in FIG. 1 or facing the end as shown in FIG. 4, or alternatively in the fixed end 66 of the canopy 16 (not shown). The coverable window 68 may be made of any suitable relatively clear flexible material. In one embodiment the clear material is Plexiglas, in another it is vinyl or plastic. The collapsible canopy 16 may be made of any suitable weather resistant material. In one embodiment, the weather resistant material is a wind- and rainproof material, such as nylon.

As described above, the moveable frame 14 is moveable between at least two positions, open or deployed, and closed or collapsed. In a preferred embodiment, the collapsible canopy 16 has the capability of moving independently of, or in tandem with, the rotatable frame 14, such that the enclosed housing position 56 of the canopy 16 corresponds to the deployed position 50 of the rotatable frame, and the closed position 58 of the canopy corresponds to the collapsed position 52 of the rotatable frame. The partially closed position 60 of the canopy 16 also corresponds to the partially deployed or collapsed position 54 of the rotatable frame 14.

The embodiment shown in FIGS. 1, 2 and 3 includes a stationary platform 18 positioned on the stationary frame 12 of the apparatus 10. In this embodiment the platform 18 is substantially rectangular in shape, and horizontal in orientation, the width and length of the platform 18 being such that at least one adult may be comfortably seated thereupon. Additional padding and cushions (not shown) may be added upon the platform 18 to make for more comfortable seating.

In the embodiment shown in FIG. 3, the apparatus 10 includes at least one retractable support member 70, and preferably a pair of such retractable support members. The retractable support member 70 is rotatably attached to the lower edge of stationary frame 12, or to stationary platform 18, and is rotatable between at least two positions, a upright position 72, substantially vertical, and a retracted position 74, substantially horizontal. When the support frame 70 is in its upright position 72, it functions to stabilize and support the apparatus 10. When the support frame 70 is in its retracted position, it takes up less space and the apparatus 10 is prepared for storage.

In one embodiment of the present invention, the apparatus 10 further comprises a connecting member 76, as shown in FIGS. 4 and 5. The connecting member 76 is attached to each crossbar 38 of the rotatable frame 14 by any suitable conventional means. For instance, the connecting member 76 may be tied to each crossbar 38 with string or rope, or the connecting means may be threaded through the crossbar. In another alternative each crossbar 38 may contain at least one loop (not shown) such that the connecting member 76 may be threaded through each such loop. In a preferred embodiment, the connecting member 76 may be constructed of the same material as the canopy 16. Thus when the canopy 16 is in the deployed position, connecting member 76 is in a maximum stretch position 78, whereas when the canopy 16 is in its closed position as shown in FIG. 3, connecting member 76 is in a minimum stretch position 80.

In yet another embodiment of the present invention, the apparatus 10 further comprises a locking member 82, to allow the rotatable frame 14 and the canopy 16 to be locked in storage position 84, as reflected by the closed position as seen in FIG. 3. The locking member 82 may also be used to put the canopy 16 in an intermediate position 88, as reflected by the partially enclosed housing 60, as seen in FIG. 5. Any suitable conventional locking member 82 may be used for this purpose. The locking member 82 in one embodiment may be a plurality of hook-and-loop strips, as those sold under the trademark Velcro. In another embodiment, the locking member 82 may be a padlock and hasp (not shown). In yet another embodiment, the locking member 82 may be any telescoping mechanism (not shown) for retaining certain locked, unlocked and partially unlocked positions.

In the embodiment shown in FIG. 5, the rotatable frame 14 includes at least one last rotatable frame 90, which further encloses a floor 92. Floor 92 is made from any suitable insulating material. In the embodiment shown in FIG. 5, the last rotatable frame 90 further includes at least one wheel 94, to aid in transportation of the apparatus 10. In another embodiment, the wheel 94 is connected to the floor 92. The floor 92 may further be formed with an orifice 93 for allowing an ice-fishing line to be deployed and used through the floor, and through the ice below, and into the water thereunder.

As indicated above, the shelter apparatus 10 includes an attachment member 20 for attaching the apparatus to vehicle 21. The vehicle 21 may be an all terrain vehicle, a trailer, a sport utility vehicle, a tractor, a car, a minivan, a truck, or any other vehicle. If the receiving vehicle 21 is an all terrain vehicle as shown in FIGS. 1–3 and 5, the attachment member 20 will be complementary to the receiving tow hitch of the all terrain vehicle. In one embodiment, the attachment member 20 may be a projected member that is communicable to the receiving member of a given vehicle. This example is only for illustrative purposes and should not be deemed to be a limitation of the present invention.

The stationary frame 12, the rotatable frame 14, the support members 70, the platform 18 and spacers 30 are constructed from materials such as light weight metal, aluminum, steel, hollow tubing, plastic, wood, synthetic material, naturally occurring materials, or combinations thereof. The selection of material may depend on the purpose of the retractable vehicle attachment apparatus 10.

Another aspect of the present invention is a method of using a shelter apparatus with attachment apparatus for a vehicle. The method may be considered to cover the processes of deploying the apparatus 10 and collapsing the apparatus. The process of deploying the apparatus 10 includes attaching the apparatus 10 to the vehicle 21 using attachment member 20, unlocking the locking member 82, rotating the rotatable frame 14 to a deployed position 50, rotating the collapsible canopy 16 to an open position 56 whereby a substantially enclosed housing is formed, and rotating the retractable support member 70 to a substantially vertical position 72. The process of collapsing the apparatus 10 includes rotating the retractable support member 72 to a substantially retracted position 74, rotating the collapsible canopy 16 to a substantially closed position 58, rotating the rotatable frame 14 to a collapsed position 52, locking the locking member 82, whereby the canopy 16 is in a substantially locked position 84 and ready for storage, and disengaging the attachment member 20 from the vehicle, so that the apparatus is separated from the vehicle and ready for storage.

The method of deploying the apparatus 10 forms the enclosed housing 56. The enclosed housing 56 may be used as an ice fishing shelter, a duck hunting blind, a tent, a camping shelter, a portable shower facility, a storage tent, a sun shade, a hunting rack for carrying hunted animals, a medical emergency shelter or a tool carrier. The method of collapsing the apparatus 10 places it into the collapsed position 58, which is the storage position for the apparatus 10.

The retractable shelter vehicle attachment apparatus and its method of use of the present invention has many other applications aside from being an ice fishing shelter, a duck hunting blind, a tent, a camping shelter, a portable shower facility, a storage tent, a sun shade, a hunting rack for carrying hunted animals, a medical emergency shelter, a tool carrier, etc.

Thus, although the invention has been herein shown and described in what is perceived to be the most practical and preferred embodiments, it is to be understood that the invention is not intended to be limited to the specific embodiments set forth above. Rather, it is recognized that modifications may be made by one of ordinary skill in the art of the invention without departing from the spirit or intent of the invention and, therefore, the invention is to be taken as including all reasonable equivalents to the subject matter of the appended claims.

What is claimed is:

1. A retractable portable shelter apparatus for a vehicle, comprising:

a stationary frame, wherein said stationary frame further comprises at least one substantially rectangular frame located along a vertical axis of the apparatus, and wherein the apparatus substantially extends only on one side of the vertical axis of the stationary frame;

at least two pivotably rotatable frames pivotably connected to the stationary frame including at least one last rotatable frame; wherein the last rotatable frame has a step-down portion for partially supporting the shelter apparatus when the shelter apparatus is in an open position;

a collapsible canopy connected to the stationary frame and the pivotably rotatable frame; and an attachment member connected to the stationary frame wherein the attachment member is adapted to removably connect the stationary frame vertically to the vehicle, and wherein the shelter apparatus is adapted to be partially supported by the vehicle.

2. A shelter apparatus of claim 1, further comprising a stationary platform connected to the stationary frame.

3. A shelter apparatus of claim 2, wherein the stationary platform is substantially perpendicular to the stationary frame and whereby at least one person may sit on said platform.

4. A shelter apparatus of claim 2, wherein the stationary platform further comprises a support frame.

5. A shelter apparatus of claim 4, wherein the support frame further comprises at least one wheel, whereby said wheel aids transportation of the apparatus.

6. A shelter apparatus of claim 2, wherein the stationary frame, the rotatable frame, the platform, the support frame and the support spacer are constructed from materials including light weight metal, aluminum, steel, hollow tubing, plastic, wood, synthetic material, naturally occurring material, or combinations thereof.

7. A shelter apparatus of claim 1, wherein said stationary frame further comprises:

at least two substantially rectangular frames, the first rectangular frame and the second rectangular frame; and at least one support spacer, whereby the first rectangular frame and the second rectangular frame are parallelly positioned from each other and communicate with said support spacer.

8. A shelter apparatus of claim 1, wherein said at least two pivotably rotatable frame comprises a plurality of rotatable frames.

9. A shelter apparatus of claim 8, wherein said plurality of pivotably rotatable frames comprises said at least two rotatable frames, including at least one last rotatable frame.

10. A shelter apparatus of claim 9, wherein the last rotatable frame further comprises at least one wheel, whereby said wheel aids transportation of the apparatus.

11. A shelter apparatus of claim 9, wherein the last rotatable frame further encloses a floor.

12. A shelter apparatus of claim 11, wherein the floor further comprises at least one wheel, where said wheel aids transportation of the apparatus.

13. A shelter apparatus of claim 11, wherein the floor further comprises an orifice, whereby said orifice aids sinking an ice fishing line through the floor.

14. A shelter apparatus of claim 11, wherein the floor is made from a resilient, insulating material.

15. A shelter apparatus of claim 9, wherein said plurality of pivotably rotatable frames are staggeredly attached to the stationary frame, whereby the rotatable frame is moveable at least two positions.

16. A shelter apparatus of claim 1, wherein the shelter apparatus is an ice fishing shelter, a duck hunting blind, a tent, a camping shelter, a portable shower facility, a storage tent, a sun shade, or a medical emergency shelter.

17. A shelter apparatus of claim 1, wherein plurality of said at least two pivotably rotatable frames include a plurality of substantially U-shaped members.

18. A shelter apparatus of claim 17, wherein said U-shaped members further comprise:

a base; and two open arms, wherein each arm comprises two ends, the top end and bottom end, respectively, whereby the bottom ends of the open arms communicate with the base of the said U-shaped member and the top ends of the open arms communicate with the stationary frame.

19. A shelter apparatus of claim 18, wherein each base of said at least two pivotably rotatable frames further comprises a connecting member, wherein the connecting member is connected to each base.

20. A shelter apparatus of claim 1, wherein the collapsible canopy is made from a lightweight resilient material.

21. A shelter apparatus of claim 1, further comprising a coverable window, wherein the window is positioned on the collapsible canopy.

22. A shelter apparatus of claim 21, wherein the coverable window is made from a resilient transparent material.

23. A shelter apparatus of claim 21, wherein the resilient transparent material is plastic, vinyl or Plexiglas.

24. A method of using a retractable portable shelter apparatus for a vehicle, wherein the apparatus comprises (a) a stationary frame wherein the stationary frame further comprises at least one substantially rectangular frame located along the vertical axis of the a apparatus whereby the apparatus substantially extends on only one side of the vertical axis of the stationary frame, (b) a plurality of rotatable frames having one last rotatable frame wherein the last rotatable frame has a step-down portion for partially supporting said shelter apparatus when the shelter apparatus is in open position, further wherein the rotatable frames communicate with the stationary frame, (c) a collapsible canopy, wherein said canopy communicates with the stationary frame and pivotably rotatable frames, (d) a stationary platform, wherein said stationary platform communicates with the stationary frame, (e) a locking member for locking and unlocking said canopy, (f) a support frame, wherein said support frame is axially attached to the stationary platform and an attachment member wherein said attachment member communicates with the vehicle and the stationary frame, said method comprising the steps of engaging the apparatus and disengaging the apparatus, wherein said engaging the apparatus comprises, attaching said apparatus to said vehicle using attaching member;

unlocking the locking member;

rotating the rotatable frame to a first engagement position;

rotating the collapsible canopy to a first open position whereby a substantially enclosed housing is formed; and rotating the support frame to a substantially vertical position, wherein the shelter apparatus is adapted to be partially supported by the vehicle;

said disengaging the apparatus comprises, rotating the support frame to a substantially horizontal position;

rotating the collapsible canopy to a second substantially closed position;

rotating the rotatable frame to a second disengagement position;

locking the locking member, whereby the said canopy is in a substantially locked position and ready for storage; and disengaging the attachment member whereby the apparatus is separated from the vehicle and ready for storage.

25. A method according to claim 24, wherein the enclosed housing is an ice fishing shelter, a duck hunting blind, a tent, a camping shelter, a portable shower facility, a storage tent, a sun shade, a hunting rack for carrying hunted animals, a medical emergency shelter or a tool carrier.

26. A method according to claim 24, wherein the pivotably rotatable frame further comprises at least two rotatable frames, including at least one last rotatable frame, said last rotatable frame further comprises an enclosed floor.

27. A retractable portable shelter apparatus with attachment member for a vehicle, comprising:

at least two substantially rectangular stationary frames along the vertical axis of the apparatus that are parallelly positioned from each other, located along the vertical axis of the apparatus;

at least two support spacers communicating and positioned between said stationary frames, whereby the vertical axis alignment of stationary frames are substantially fixedly maintained;

a plurality of U-shaped pivotably rotatable frames wherein the rotating frames communicate with the stationary frame and wherein the rotatable frames are moveable in at least two positions, further wherein the rotatable frames have at least one last rotatable frame; wherein the last rotatable frame has a step-down portion for partially supporting the shelter apparatus when the shelter apparatus is in an oven position;

a collapsible canopy, wherein said canopy communicates wit the stationary frame and rotatable frame, and wherein the canopy is moveable in at least two positions;

a stationary platform, wherein the stationary platform communicates with the stationary frame; and an attachment member, wherein said attachment member is adapted to removably connect the stationary frame vertically to the vehicle and wherein the shelter apparatus is adapted to be partially supported by the vehicle.

28. A shelter apparatus of claim 27, wherein the shelter apparatus is an ice fishing shelter, a duck hunting blind, a tent, a camping shelter, a portable shower facility, a storage tent, a sun shade, or a medical emergency shelter.

29. A shelter apparatus of claim 27, wherein the shelter apparatus is a hunting rack for carrying hunted animals or a tool carrier.

* * * * *